US008211709B2

(12) United States Patent
Beebe et al.

(10) Patent No.: US 8,211,709 B2
(45) Date of Patent: Jul. 3, 2012

(54) METHOD FOR CONTROLLING COMMUNICATION BETWEEN MULTIPLE ACCESS PORTS IN A MICROFLUIDIC DEVICE

(75) Inventors: David J. Beebe, Monona, WI (US); Ivar Meyvantsson, Madison, WI (US); Jay W. Warwick, Madison, WI (US); Michael Toepke, Normal, IL (US)

(73) Assignee: Wisconsin Alumni Research Foundation, Madison, WI (US)

( * ) Notice: Subject to any disclaimer, the term of this patent is extended or adjusted under 35 U.S.C. 154(b) by 1049 days.

(21) Appl. No.: 11/843,291

(22) Filed: Aug. 22, 2007

(65) Prior Publication Data

US 2009/0051716 A1 Feb. 26, 2009

(51) Int. Cl.
*B01L 3/00* (2006.01)

(52) U.S. Cl. ..... 436/180; 422/504; 422/507

(58) Field of Classification Search ..... 436/180; 422/504, 507

See application file for complete search history.

(56) References Cited

U.S. PATENT DOCUMENTS

| | | | |
|---|---|---|---|
| 6,012,902 | A | 1/2000 | Parce |
| 6,090,251 | A | 7/2000 | Sundberg et al. |
| 6,171,067 | B1 | 1/2001 | Parce |
| 6,174,675 | B1 | 1/2001 | Chow et al. |
| 6,210,128 | B1 | 4/2001 | Rife et al. |
| 6,224,728 | B1 | 5/2001 | Oborny et al. |
| 6,262,519 | B1 | 7/2001 | Furlani et al. |
| 6,274,089 | B1 | 8/2001 | Chow et al. |
| 6,296,452 | B1 | 10/2001 | Caren |
| 6,318,970 | B1 | 11/2001 | Backhouse |
| 6,368,562 | B1 | 4/2002 | Yao |
| 6,739,576 | B2 | 5/2004 | O'Connor et al. |
| 6,767,706 | B2 | 7/2004 | Quake et al. |
| 6,949,176 | B2 | 9/2005 | Vacca et al. |
| 7,156,969 | B2 | 1/2007 | Mehta et al. |
| 2003/0203506 | A1 | 10/2003 | Beebe et al. |
| 2004/0115830 | A1 | 6/2004 | Touzov |

OTHER PUBLICATIONS

Toepke et al, Lab Chip (2007) vol. 7, pp. 1449-1453.*
Walker et al, Lab Chip (2002) vol. 2, pp. 131-134.*
"Macro-to-Micro Interfaces for Microfluidic Devices", Miniaturization for Chemisty, Biology & Bioengineering; vol. 4, pp. 526-533, Jul. 13, 2004, by Carl K. Fredrickson and Z. Hugh Fan.
"Well-Plate Formats and Microfluidics—Applications of Laminar Fluid Diffusion Interfaces to HTP Screening", Micro Total Analysis Systems 2001, pp. 383-384, by Bernard H. Weigl et al.

* cited by examiner

*Primary Examiner* — Jan Ludlow
(74) *Attorney, Agent, or Firm* — Boyle Fredrickson, S.C.

(57) ABSTRACT

A method is provided of controlling communication between multiple ports in a microfluidic device. The method includes the step of providing a channel network in a microfluidic device. The channel network including a first channel having a first input port and an output port. The first channel is filled with a fluid and a first output droplet is deposited on the output port. The first output droplet has a radius of curvature. The first output droplet flows toward the first input port in response to placement of a first input droplet having a radius of curvature greater than the radius of curvature of the first output droplet on the first input port. The first input droplet flows toward the output port in response to the first input droplet having a radius of curvature less than the radius of curvature of first output droplet.

5 Claims, 7 Drawing Sheets

METHOD FOR CONTROLLING COMMUNICATION BETWEEN MULTIPLE ACCESS PORTS IN A MICROFLUIDIC DEVICE

REFERENCE TO GOVERNMENT GRANT

This invention was made with United States government support awarded by the following agencies: ARMY/MRMC W81XWH-04-1-0572; and NIH CA104162. The United States has certain rights in this invention

FIELD OF THE INVENTION

This invention relates generally to microfluidic devices, and in particular, to a method for controlling communication between multiple access ports in a microfluidic device in order to create a plurality of digital microfluidic circuit components.

BACKGROUND AND SUMMARY OF THE INVENTION

Microfluidic devices have been used to explore a variety of biological problems of interest, ranging from fundamental research in protein crystallization to diagnostic assays. A number of these applications require the integration of valves, mixers, and other components into the devices in order to successfully carry out various steps. The incorporation of actively controlled functionalities, either directly in the device or via fixed interface with external components, often leads to more complex fabrication and the need for ancillary equipment. The use of passive and autonomous microfluidic components, while sometimes requiring more complex fabrication, can help to reduce or eliminate the need for additional equipment. Eliminating external components makes point-of-care devices more portable and facilitates operation of many devices in parallel, which is of particular interest for large parametric screening applications.

Many of the fabrication methods used to create microfluidic devices were first developed for microelectronics, so it is fitting that a number of parallels can be drawn between the two fields. Resistance, driving forces (pressure/voltage), and current (fluid/electrons) analogies are commonly used to compare electronic components and fluid networks. The analogy has been further extended in microfluidics to include diodes, rectifiers, memory elements, and capacitors. Two-phase flow has recently been used to encode and decode data sets using droplets. As with electronics, microfluidic components can be combined to form more complex devices and a microfluidic breadboard has already been demonstrated. Microfluidics can also be used to address problems that are not easily solved using standard computational methods. Regulatory systems can also be implemented in microfluidic devices. Responsive hydrogels have been used in microfluidic devices to regulate the pH or temperature of a solution. The use of pneumatic control in three dimensional channel structures has been shown as a means of self-regulation flow. Hence, it is highly desirable to couple a conditional action to more than one input, thereby enabling the creation of logic gates, which can be combined to perform computation and more complex functions.

Fluidic logic elements can be traced back to the 1950's; however, most of the early constructs depended on turbulent and multistable flow states, which are not scalable due to the low Reynolds numbers that are typically observed in microfluidic channels. More recent efforts using microfluidics have employed fluidic resistance, electrochemistry, pneumatics, channel geometry, multiphase flow, and chemistry to create logic elements. Many of these approaches rely on continuous flow and are unable to create more integrated constructs due to different input/output (e.g. pressure/dye). Additionally, the electronic components used to input and read out signals are more complex than the devices themselves. Ideally, fluidic logic elements would use consistent signal input/output and require minimal supporting equipment.

Therefore, it is a primary object and feature of the present invention to provide a method for controlling communication between multiple access ports in a microfluidic system in order to create a plurality of digital microfluidic circuit components.

It is a further object and feature of the present invention to provide a method for controlling communication between multiple access ports in a microfluidic system to create fluidic logic gates in the microfluidic system.

It is a still further object and feature of the present invention to provide a method for controlling communication between multiple access ports in a microfluidic system in order to allow various computations and complex functions to be performed with the system.

In accordance with the present invention, a method is provided of controlling communication between multiple ports in a microfluidic device. The method includes the step of providing a channel network in a microfluidic device. The channel network includes a first channel having a first input port and an output port. The first channel is filled with a fluid and a first output droplet is deposited on the output port. The first output droplet has a radius of curvature. The first output droplet flows toward the first input port in response to placement of a first input droplet having a radius of curvature greater than the radius of curvature of the first output droplet on the first input port.

The first channel includes a second input port. The first output droplet flows toward the second input port in response to placement of a second input droplet having a radius of curvature greater than the radius of curvature of the first output droplet on the second input port. The method also includes the additional step of depositing a first input droplet on the first input port. The first input droplet flows toward the output port in response to the first input droplet having a radius of curvature less than the radius of curvature of the first output droplet. A second input port is provided for the first channel. A second input droplet is deposited on the second input port. The second input droplet flows toward the output port in response to the second input droplet having a radius of curvature less than the radius of curvature of the first output droplet.

The channel network may include a second channel. The second channel has an input port and an output port. The input port of the second channel is placed in proximity to the output port of the first channel. The first output droplet communicates with the input port of the second channel when the first output droplet exceeds a predetermined volume. A second output droplet is deposited on the output port of the second channel. The second output droplet has a radius of curvature wherein the first output droplet flows toward the output port of the second channel in response to the first output droplet communicating with the input port of the second channel and having a radius of curvature less than the radius of curvature of the second output droplet on the output port of the second channel.

In accordance with a further aspect of the present invention, a method is provided of controlling communication between multiple ports in a microfluidic device. The method includes the step of providing a channel network in a microfluidic device. The channel network includes a first channel having first and second input ports and an output port. The first channel is filled with a fluid. A first output droplet is deposited on the output port. The first output droplet has a radius of curvature. A first input droplet is deposited on the first input port. The first input droplet flows toward the output port in response to the first input droplet having a radius of curvature less than the radius of curvature of the first output droplet. The first output droplet flows toward the first input port when the first input droplet has a radius of curvature greater than the radius of curvature of the first output droplet.

A second input droplet may be deposited on the second input port. The second input droplet flows toward the output port in response to the second input droplet having a radius of curvature less than the radius of curvature of the first output droplet. The first output droplet flows toward the second input port in response the second input droplet having a radius of curvature greater than the radius of curvature of the first output droplet.

The channel network may include a second channel. The second channel has an input port and an output port. The input port of the second channel is positioned in proximity to the output port of the first channel. The first output droplet communicates with the input port of the second channel when the first output droplet exceeds a predetermined volume. A second output droplet may be deposited on the output port of the second channel. The second output droplet has a radius of curvature wherein the first output droplet flows toward the output port of the second channel in response to the first output droplet communicating with the input port of the second channel and having a radius of curvature less than the radius of curvature of the second output droplet on the output port of the second channel.

In accordance with a further aspect of the present invention, a method is provided of controlling communication between multiple ports in a microfluidic device. The method includes the step of providing a channel network in a microfluidic device. The channel network includes a first channel having a first input port and an output port. The first channel is filled with a fluid. A first output droplet is deposited on the output port. The first output droplet has a radius of curvature. A first input droplet is deposited on the first input port. The first input droplet has a radius of curvature. The first output droplet flows toward the first input port when the first input droplet has a radius of curvature greater than the radius of curvature of the first output droplet. The first input droplet flows toward the output port in response to the first input droplet having a radius of curvature less than the radius of curvature of the first output droplet.

The method may include the additional steps of providing a second input port for the first channel and depositing a second input droplet on the second input port. The second input droplet flows toward the output port in response the second input droplet having a radius of curvature less than the radius of curvature of the first output droplet. The first output droplet flows toward the second input port in response the second input droplet having a radius of curvature greater than the radius of curvature of the first output droplet.

The channel network may include a second channel. The second channel has an input port and an output port. The input port of the second channel is positioned in proximity to the output port of the first channel. The first output droplet communicates with the input port of the second channel when the first output droplet exceeds a predetermined volume. A second output droplet is deposited on the output port of the second channel. The second output droplet has a radius of curvature wherein the first output droplet flows toward the output port of the second channel in response to the first output droplet communicating with the input port of the second channel and having a radius of curvature less than the radius of curvature of the second output droplet on the output port of the second channel.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
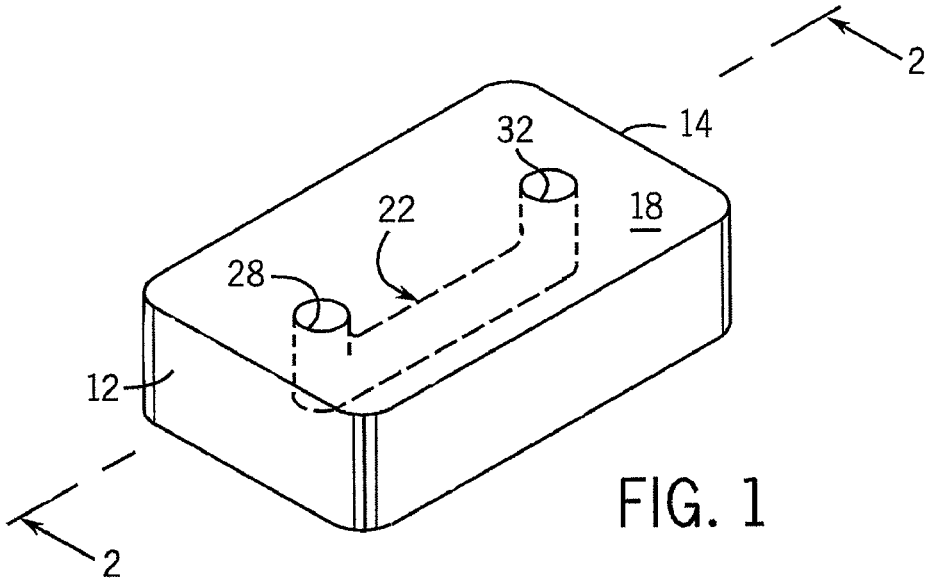
FIG. 1 is an isometric view of a microfluidic device for use in performing the methodology of the present invention.
Figure 2:
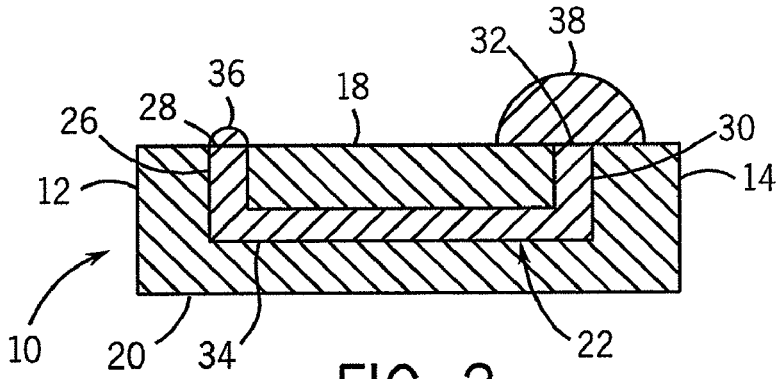
FIG. 2 is a cross-sectional view of the microfluidic device taken along line 2-2 of FIG. 1.

Referring to FIGS. 1-2, a microfluidic device for use in the method of the present invention is generally designated by the reference numeral 10. Microfluidic device 10 may be formed from polydimethylsiloxane (PDMS) or other suitable material and has first and second ends 12 and 14, respectively, and upper and lower surfaces 18 and 20, respectively. Channel 22 extends through microfluidic device 10 and includes a first vertical portion 26 terminating at an input port 28 that communicates with upper surface 18 of microfluidic device 10 and a second vertical portion 30 terminating at an output port 32 also communicating with upper surface 18 of microfluidic device 10. First and second vertical portions 26 and 30, respectively, of channel 22 are interconnected by and communicate with horizontal portion 34 of channel 22. The dimension of channel 22 connecting input port 28 and output port 32 is arbitrary. In the depicted embodiment, the input ports and output ports of microfluidic device 10 have generally circular configurations. However, alternate configurations, such as slit-shaped and oval ports, are possible without deviating from the scope of the present invention. It has been found the oval ports are better for directing drop growth, as hereinafter described, in a particular direction. In addition, it has been found that drops are more thoroughly pumped away, as hereinafter described, from slit-shaped ports.

The amount of pressure present within a drop of liquid at an air-liquid interface is given by the Young-LaPlace equation:

$$\Delta P=\gamma(1/R1+1/R2) \quad \text{Equation (1)}$$

wherein γ is the surface free energy of the liquid; and R1 and R2 are the radii of curvature for two axes normal to each other that describe the curvature of the surface of first drop 36.

For spherical drops, Equation (1) may be rewritten as:

$$\Delta P=2\gamma/R \quad \text{Equation (2)}$$

wherein: R is the radius of the spherical first drop 36.

From Equation (2), it can be seen that smaller drops have a higher internal pressure than larger drops. Therefore, if two drops having different radii of curvature are connected via a fluid-filled tube (i.e. channel 22), the drop with the smaller radius of curvature will shrink while the larger one grows in size. One manifestation of this effect is the pulmonary phenomenon called "instability of the alveoli" which is a condition in which large alveoli continue to grow while smaller ones shrink. As described, fluid can be pumped through channel 22 by using the surface tension in first and second drops 36 and 38, respectively, on input port 28 and output port 32 of channel 22.

Figure 3:
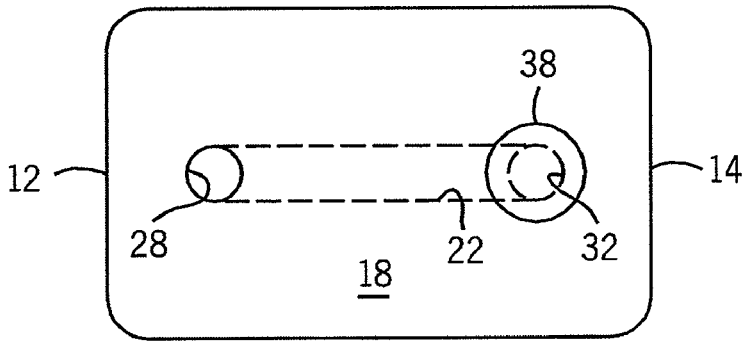
FIG. 3 schematic, top plan view of the microfluidic device of FIG. 1.
Figure 4:
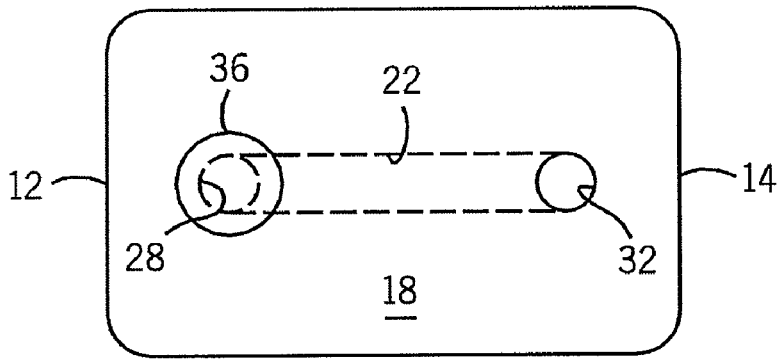
FIG. 4 schematic, top plan view of the microfluidic device of FIG. 1.

It can be appreciated that the embodiment disclosed in FIGS. 1-2 may be used as an inverter. More specifically, referring to FIGS. 3-4, channel 22 may be filed with a fluid and second drop 38 may be placed on output port 32 of channel 22. If no drop is placed on input port 28 of channel 32 (in other words, there is an input of 0 at input port 28), second drop 38 placed on output port 32 of channel 22 remains. Hence, the "value" of channel 22 at output port 32 would be 1, while the value of the channel at input port 28 would remain 0. Thereafter, first drop 36 may be placed on input port 28 of channel 22. If first drop 36 on input port 28 is larger than second drop 38 on output port 32, second drop 28 will be pumped from the output port 32 to the input port 28. As a result, the value of channel 22 at output port 32 would be 0, while the value of the input port 28 would be 1.

Figure 5:
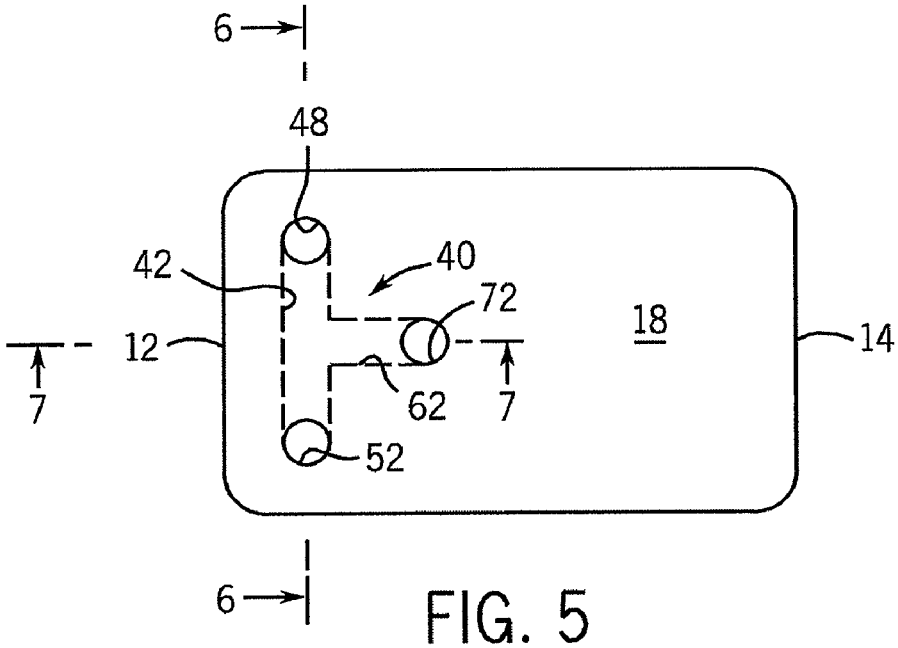
FIG. 5 schematic, top plan view of a further embodiment of a microfluidic device for use in performing the methodology of the present invention.
Figure 6:
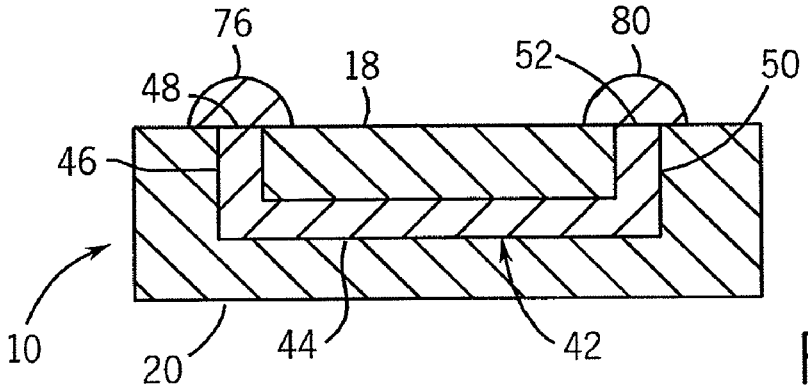
FIG. 6 is a cross-sectional view of the microfluidic device taken along line 6-6 of FIG. 5.
Figure 7:
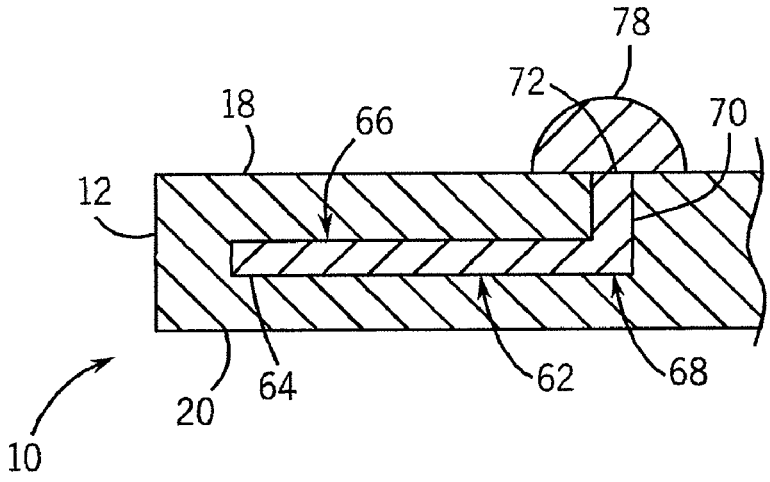
FIG. 7 is a cross-sectional view of the microfluidic device taken along line 7-7 of FIG. 5.

Referring to FIGS. 5-7, a further embodiment of a channel network for microfluidic device 10 is generally designated by the reference numeral 40. Channel network 40 includes first channel 42 that extends through microfluidic device 10 and includes a first vertical portion 46 terminating at first input port 48 that communicates with upper surface 18 of microfluidic device 10 and a second vertical portion 50 terminating at a second input port 52 also communicating with upper surface 18 of microfluidic device 10. First and second vertical portions 46 and 50, respectively, of channel 42 are interconnected by and communicate with horizontal portion 44 of channel 42. The dimension of channel 42 connecting input ports 48 and 52 is arbitrary.

Channel network 40 further includes second channel 62 that extends through microfluidic device 10 and includes a horizontal portion 64 having a first end 66 communicating with first channel 42 and a second end 68 communicating with vertical portion 70. Vertical portion 70 of second channel 62 terminates at output port 72 that communicates with upper surface 18 of microfluidic device 10. The dimension of second channel 62 connecting first channel 42 and output port 72 is arbitrary.

Figure 8:
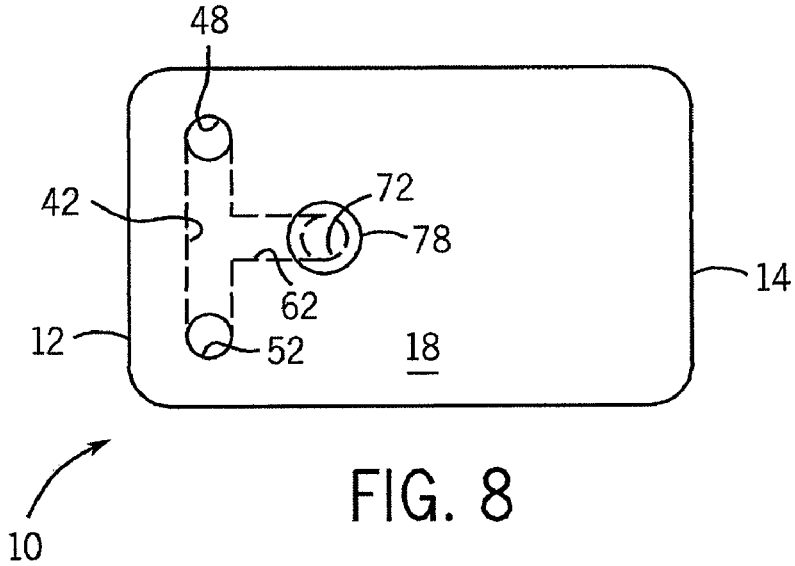
FIG. 8 schematic, top plan view of the microfluidic device of FIG. 5.
Figure 9:
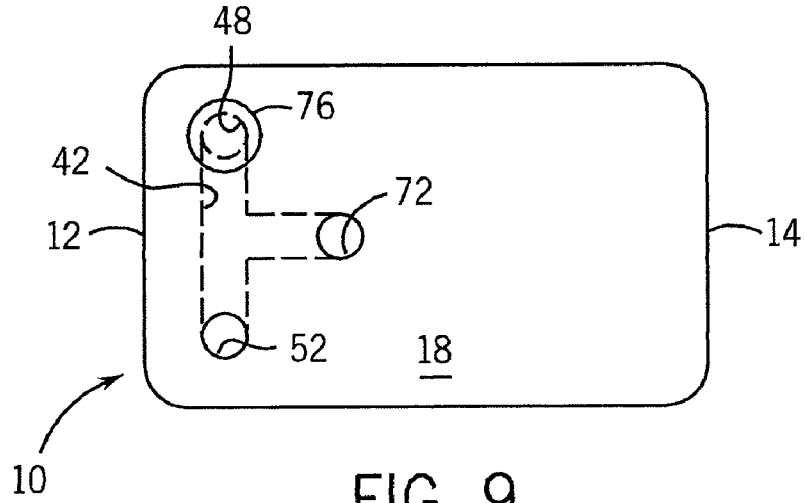
FIG. 9 schematic, top plan view of the microfluidic device of FIG. 5.
Figure 10:
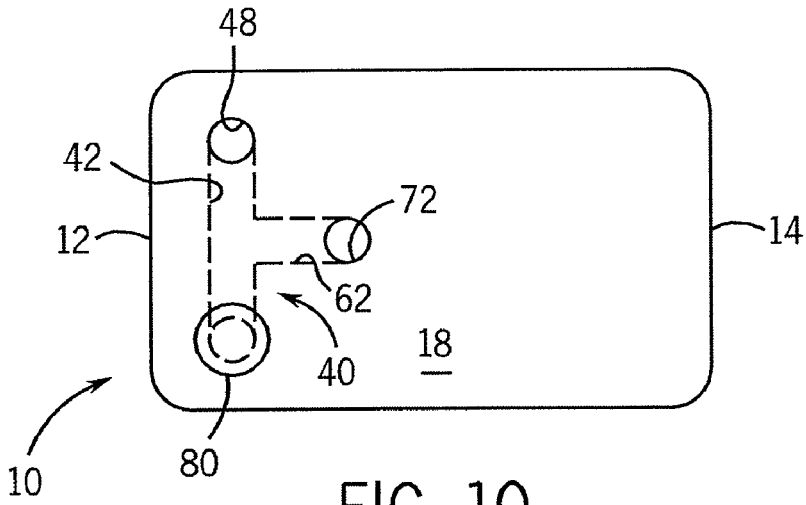
FIG. 10 schematic, top plan view of the microfluidic device of FIG. 5.
Figure 11:
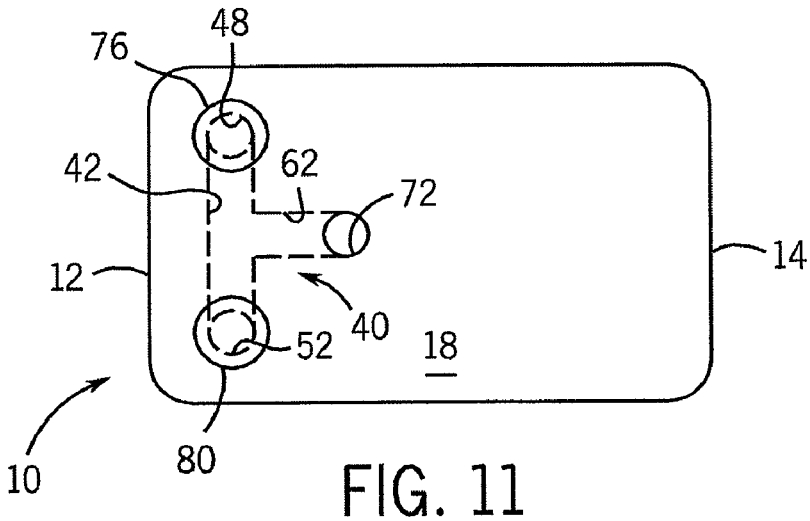
FIG. 11 schematic, top plan view of the microfluidic device of FIG. 5.

It can be appreciated that the embodiment disclosed in FIGS. 5-7 may be used as a NOR gate. More specifically, referring to FIGS. 8-11, channel network 40 is filled with a fluid and output drop 78 is placed on output port 72 of second channel 62. If no drop is placed on input ports 48 and 52 of first channel 42 (in other words, there are inputs of 0 at input ports 48 and 52), output drop 78 placed on output port 72 of second channel 62 remains. Hence, the "value" at output port 72 of second channel 42 would be 1, while the values at input ports 48 and 52 would remain 0, FIG. 8. Thereafter, if a first drop 76 is placed on input port 48 of first channel 42 that is larger than output drop 78 on output port 72, output drop 78 will be pumped from the output port 72 to the input port 48. As a result, the value at output port 72 would be 0, while the value of the input port 48 would be 1, FIG. 9. Similarly, if a second drop 80 is placed on input port 52 of first channel 42 that is larger than output drop 78 on output port 72, output drop 78 will be pumped from the output port 72 to the input port 52. Hence, the value at output port 72 would be 0, while the value of the input port 52 would be 1, FIG. 10. Finally, if first and second drops 76 and 80, respectively, are placed on input ports 48 and 52, respectively, of first channel 42 that are larger than output drop 78 on output port 72, output drop 78 will be pumped from the output port 72 to the input ports 48 and 52. Hence, the value at output port 72 would be 0, while the values of input ports 48 and 52 would be 1, FIG. 11.

As hereinafter described, it can be appreciated that same design can be used as an OR gate or an AND gate by simply changing the size or number of drops that are used to define an input of 1. In other words, the size of the drops can be varied to change the type of gate that is created with a given channel geometry. As is known, OR/AND gates require an output of 1 only if at least one of the inputs is 1. As such, fluid must be pumped to a port originally without a drop deposited thereon. While a larger droplet has heretofore been used as a low-pressure sink in the passive pumping method, it is not a necessity. For the OR/AND gates, output port **72*a* is formed with a radius larger than that of the radius of input ports 48 and 52. As a result, the curvature of the meniscus in the output port is large enough to drive fluid flow to output port 72*a* from input ports 48 and 52, provided sufficiently small drops are used on input ports 48 and 52**.

Figure 12:
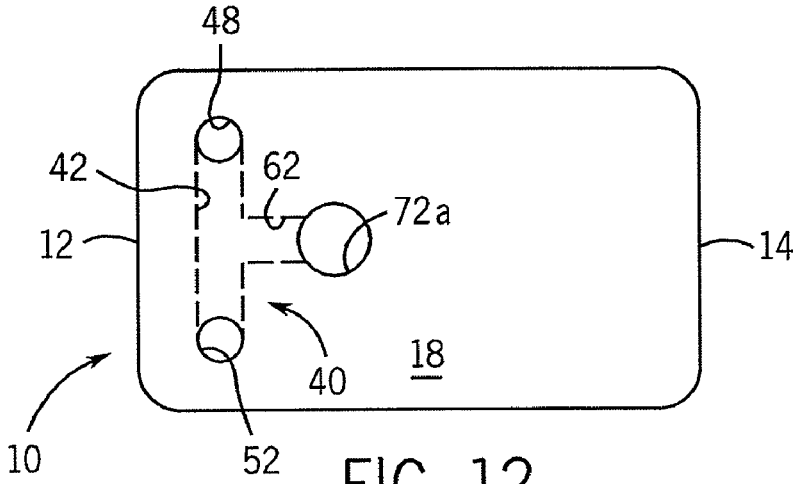
FIG. 12 schematic, top plan view of a still further embodiment of a microfluidic device for use in performing the methodology of the present invention.
Figure 13:
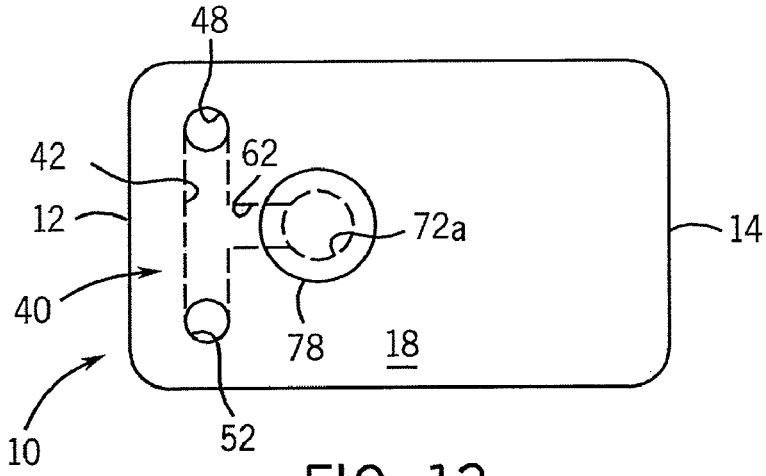
FIG. 13 schematic, top plan view of the microfluidic device of FIG. 12.

Referring to FIGS. 12-13, to operate as an AND gate, channel network 40 is filled with a fluid. If no drop is placed on input ports 48 and 52 of first channel 42 or output port **72*a* (in other words, there are inputs of 0 at input ports 48 and 52), the "value" of second channel 62 at output port 72*a* would be 0. Thereafter, if a first drop 76 is placed on input port 48 of first channel 42, that drop 76 will be pumped to output port 72*a*. However, while the value at input port 48 goes to 0, the value at output port 72*a* remains 0, since the volume of first drop 76 is small as compared to the size of output port 72*a*, FIG. 12. Similarly, if a second drop 80 is placed on input port 52 of first channel 42, that drop is pumped to the output port 72*a*. However, while the value at input port 52 goes to 0, the value at output port 72***a* remains 0, since the volume of second drop 80 is small as compared to the size of output port 72*a*, FIG. 12. Finally, if first and second drops 76 and 80, respectively, are placed on input ports 48 and 52 of first channel 42, first and second drops 76 and 80, respectively, are pumped to output port 72*a*. The resulting fluid flow of the first and second drops 76 and 80, respectively, displaces the air/liquid interface from within output port 72*a* to form output drop 78 at output port 72*a*. Hence, the value at output port 72*a* would be 1, while the values of input ports 48 and 52 would be 0, FIG. 13.

Referring specifically to FIG. 13, in order to operate as an OR gate, channel network 40 is filled with a fluid. If no drop is placed on input ports 48 and 52 of first channel 42 or output port 72*a* (in other words, there are inputs of 0 at input ports 48 and 52), the "value" of second channel 42 at output port 72*a* would be 0. Thereafter, if a first drop 76 having an enlarged volume is placed on input port 48 of first channel 42, that drop 76 will be pumped to output port 72*a*. As the value at input port 48 goes to 0, first drop 76 displaces the air/liquid interface from within output port 72*a* to form output drop 78 at output port 72. The value at output port 72*a* would be 1, while the values of input ports 48 and 52 would be 0. Similarly, if an enlarged second drop 80 is placed on input port 52 of first channel 42, second drop 80 is pumped to the output port 72*a*. As the value at input port 52 goes to 0, second drop 80 displaces the air/liquid interface from within output port 72*a* to form output drop 78 at output port 72. Hence, the value at output port 72*a* would be 1, while the values of input ports 48 and 52 would be 0. Finally, if first and second drops 76 and 80, respectively, are placed on first and second input ports 48 and 52, respectively, of first channel 42, first and second drops 76 and 80, respectively, are pumped to output port 72*a*. The resulting fluid flow of the first and second drops 76 and 80, respectively, displaces the air/liquid interface from within output port 72*a* to form output drop 78 at output port 72*a*. Hence, the value at output port 72*a* would be 1, while the values of input ports 48 and 52 would be 0.

Figure 14:
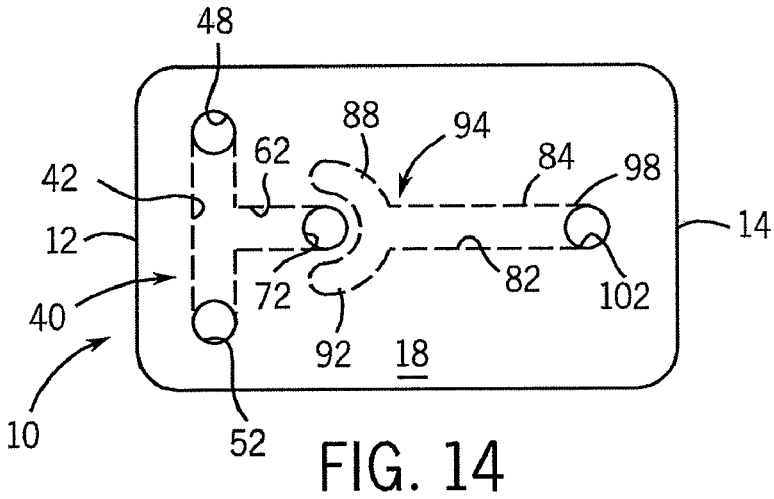
FIG. 14 schematic, top plan view of a still further embodiment of a microfluidic device for use in performing the methodology of the present invention.

Referring to FIG. 14, a NAND gate can be constructed by incorporating a third channel 82 into channel network 40. More specifically, third channel 82 extends through microfluidic device 10 and includes a first vertical portion terminating at first input port 88 that communicates with upper surface 18 of microfluidic device 10 and a second vertical portion terminating at a second input port 92 also communicating with upper surface 18 of microfluidic device 10. First and second input ports 88 and 92, respectively, are positioned in close proximity to output port 72 of second channel 62, for reasons hereinafter described. In addition, first and second input ports 88 and 92, respectively, of channel 82 are interconnected by and communicate with first end 94 of horizontal portion 84 of channel 82. Horizontal portion 84 of third channel 82 further includes a second end 98 communicating with output port 102 that communicates with upper surface 18 of microfluidic device 10.

Figure 15:
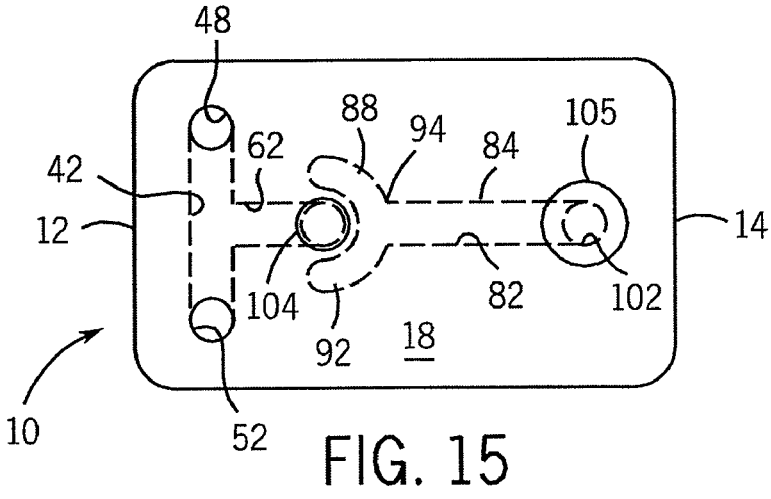
FIG. 15 schematic, top plan view of the microfluidic device of FIG. 14.
Figure 16:
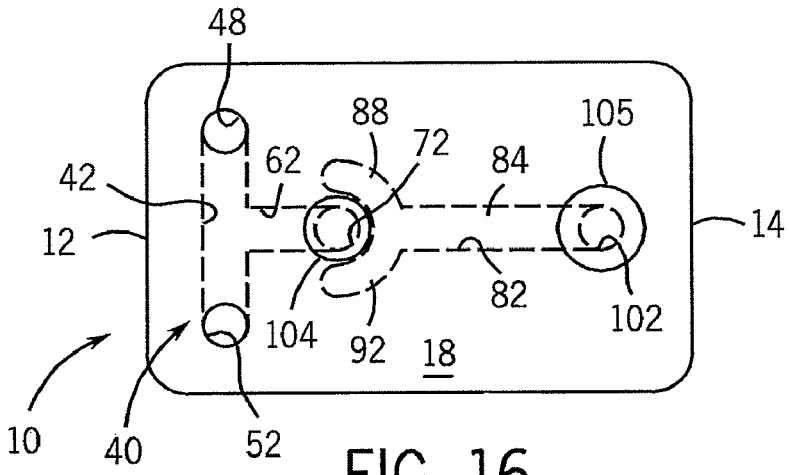
FIG. 16 schematic, top plan view of the microfluidic device of FIG. 14.
Figure 17:
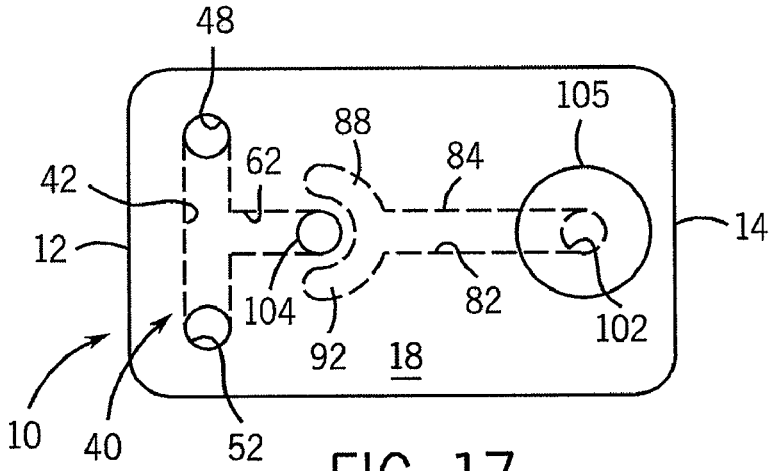
FIG. 17 schematic, top plan view of the microfluidic device of FIG. 14.

In operation, first, second and third channels 42, 62 and 82, respectively, of channel network 40 are filled with a fluid. Referring to FIG. 15, drop 104 is placed on output port 72 of second channel 62. Drop 104 is of sufficient size to overlap output port 72, but does not communicate with first and second input ports 88 and 92, respectively, of third channel 82. In addition, drop 105 is positioned on output port 102 of third channel 82. Drop 105 has a radius of curvature greater than the radius of curvature of drop 104. Thereafter, if first drop 76 is placed on input port 48 of first channel 42, that drop 76 will be pumped to output port 72, thereby increasing the size of drop 104, FIG. 16. However, drop 104 will not grow to such size as to overlap and communicate with first and second input ports 88 and 92, respectively, of third channel 82. As such, the value at output port 72 would be 1, while the values of input ports 48 and 52 would be 0. Similarly, if second drop 80 is placed on input port 52 of first channel 42, second drop 80 is pumped to the output port 72, thereby increasing the size of drop 104, FIG. 16. However, drop 104 will not grow to such a size as to overlap and communicate with first and second input ports 88 and 92, respectively, of third channel 82. As such, the value at output port 72 would be 1, while the values of input ports 48 and 52, respectively, would be 0. Finally, if first and second drops 76 and 80, respectively, are placed on input ports 48 and 52 of first channel 42, first and second drops 76 and 80, respectively, are pumped to output port 72. The resulting fluid flow of the first and second drops 76 and 80, respectively, increases the size of drop 104 such that drop 104 communicates with first and second input ports 88 and 92, respectively, of third channel 82. Drop 104 is then be pumped away through third channel 82 to output port 102, leaving an output of 0 at output port 72 of second channel 62, FIG. 17.

It can be appreciated that the NAND gate, heretofore described, can be operated as a NOR gate by increasing the size of drop 104 on output port 72 or the size of drops 76 and 80 on first and second input ports 48 and 52, respectively, of first channel 42. More specifically, if first drop 76 is placed on input port 48 of first channel 42, that drop 76 will increase the size of drop 104 to a sufficient dimension so as to overlap and communicate with first and second input ports 88 and 92, respectively, of third channel 82. Drop 104 is then pumped away through third channel 82 to output port 102, leaving an output of 0 at output port 72 of second channel 62, FIG. 17. Similarly, if second drop 80 is placed on input port 52 of first channel 42, second drop 80 is pumped to output port 72, thereby increasing the size of drop 104. Drop 104 is then pumped away through third channel 82 to output port 102, leaving an output of 0 at output port 72 of second channel 62, FIG. 17. Finally, if first and second drops 76 and 80, respectively, are placed on input ports 48 and 52, respectively, of first channel 42, first and second drops 76 and 80, respectively, are pumped to output port 72. The resulting fluid flow of the first and second drops 76 and 80, respectively, increases the size of drop 104 such that drop 104 communicates with first and second input ports 88 and 92, respectively, of third channel 82. Drop 104 is then pumped away through third channel 82 to output port 102, leaving an output of 0 at output port 72 of second channel 62, FIG. 17.

An XNOR gate can be formed by modifying the third channel 82 of the NAND/NOR design to have a high fluidic resistance. Output port 72 of second channel 62 of the XNOR gate is primed with drop 104, as with the NAND/NOR configuration. A single drop either 76 or 80 on either first or second input ports 48 and 52, respectively, of first channel 42, is sufficient to increase the size of drop 104 such that drop 104 communicates with first and second input ports 88 and 92, respectively, of third channel 82. Drop 104 is then be pumped away through third channel 82 to output port 102, though at a slower rate than in the case of the NOR gate, leaving an output of 0 at output port 72 of second channel 62. The addition of a second drop 76 or 80 on the other of the first or second input ports 48 and 52, respectively, of first channel 42, can then be used to increase the volume of drop 104 such that drop 104 is larger than drop 105 positioned on output port 102 of third channel 82, provided that drop 104 grows at a much faster rate than drop 105. Thus, the drop 104 remains only if the values at first and second input ports 48 and 52, respectively, are either 0/0 or 1/1.

In view of the foregoing, it can be appreciated that multi-channel designs can also be used to merge and split individual drop. For example, channels may be used to either split an individual drop or merge two separate drops. The output drops of a central channel can be split between two side channels if the radius of curvature of the drop is smaller than both of the outer channels. Alternatively, a central drop can be used to mix the two drops from corresponding feeder channels if the radius of curvature of the central drop is larger than the radius of curvature of the drops from the feeder channels. Further, a number of channels can be connected in series by using the output of a preceding channel as the input for next channel. In addition to potentially enabling several gates to be connected in series, the cascading nature of some of the gates confers a degree of temporal control over subsequent pumping steps. That is, a set amount of time may be required for the initial input drop(s) to be pumped through a given channel before the output drop will reach a critical size to carry out the next pumping step.

Figure 18:
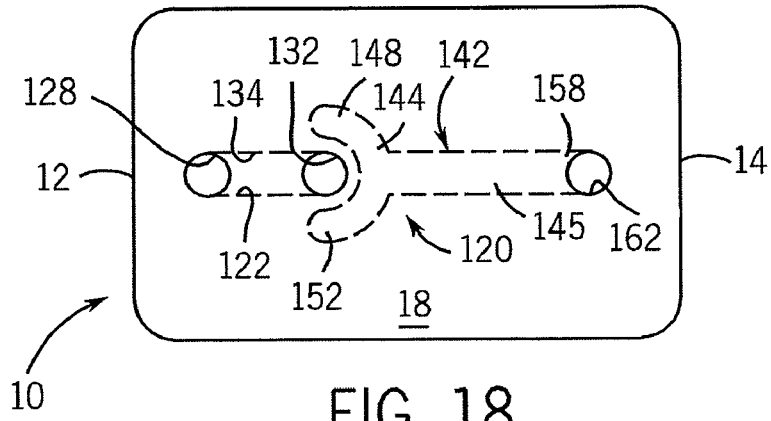
FIG. 18 schematic, top plan view of a still further embodiment of a microfluidic device for use in performing the methodology of the present invention.

Referring to FIG. 18, a passive timer may be constructed with a two-channel design similar to the NAND gate. More specifically, microfluidic device 10 may include a channel network 120 having a first channel 122 extending through microfluidic device 10. First channel 122 includes a first vertical portion terminating at an input port 128 that communicates with upper surface 18 of microfluidic device 10 and a second vertical portion terminating at an output port 132 also communicating with upper surface 18 of microfluidic device 10. First and second input ports 128 and 132, respectively, of channel 122 are interconnected by and communicate with horizontal portion 134 of channel 122. First channel 122 is made with a high fluidic resistance that acts like an hourglass of sorts, with fluid moving from one end of the channel to the other.

Channel network 120 further includes a second channel 142. Second channel 142 extends through microfluidic device 10 and includes a first vertical portion terminating at first input port 148 that communicates with upper surface 18 of microfluidic device 10 and a second vertical portion terminating at a second input port 152 also communicating with upper surface 18 of microfluidic device 10. First and second input ports 148 and 152, respectively, are positioned in close proximity to output port 132 of first channel 122, for reasons hereinafter described. First and second input ports 148 and 152, respectively, of second channel 142 are interconnected by and communicate with first end 144 of horizontal portion 145 of second channel 142. Horizontal portion 145 of second channel 142 further includes a second end 158 communicating with output port 162 that, in turn, communicates with upper surface 18 of microfluidic device 10.

Figure 19:
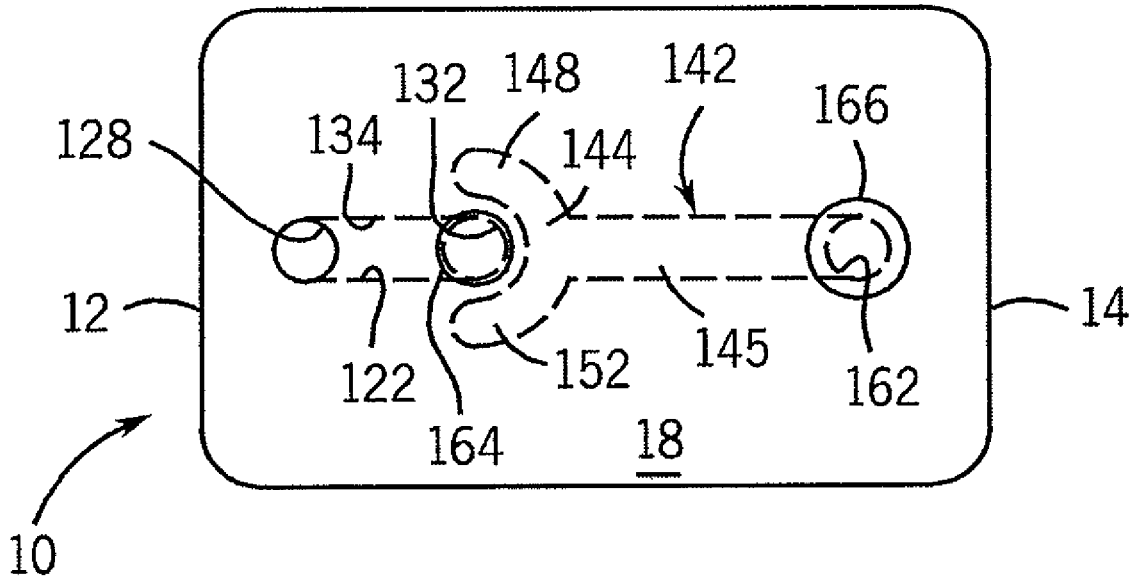
FIG. 19 schematic, top plan view of the microfluidic device of FIG. 19.

In operation, output drops 164 and 166 are placed on corresponding output ports 132 and 162, respectively, of first and second channels 122 and 142, respectively, FIG. 19. Thereafter, a first input drop is deposited on input port 128 of first channel 122 such that fluid is pumped through the high-resistance first channel 122 to output port 132. The output drop 164 eventually grows large enough to overlap inlet ports 148 and 152 of second channel 142, creating a fluid connection between the first and second channels 122 and 142, respectively. If the pressure in output drop 164 is greater than the pressure at output port 162 of second channel 142, the fluid connecting the two channels will be pumped through second channel 142. Output drop 164 may be completely pumped away or a portion of the liquid can be left behind to maintain the connection, depending on the design of output port 132. The time required to achieve fluidic connection is determined by the fluid resistance of first channel 122, i.e., the dimensions of first channel 122, and by the size of the inlet drop and output drops 164 and 166.

It can be appreciated that a central channel with multiple input ports can be used to provide variable fluidic resistance, thereby allowing for a wide range of times to be set using a single device. Time delays ranging from a few seconds to a number of hours can be achieved by varying the channel resistance and initial pressure differential. Further, multiple timing channels can be used to carry out a series of treatments on an individual channel. In addition, the multi-inlet design used for the variable timer structure can also be used to generate continuous slow perfusion by connecting each input port directly to a central channel having portions of both high and low fluidic resistance. The flow rate varies over the course of the pumping due to the changing volume of the source (input port) and sink (output port) drop; however, the variation is gradual because the volumetric flow rate is small relative to the overall drop size for a significant portion of the process. The variation in flow rate can be partially compensated for by using several drops along a multi-inlet path. Drops furthest away from the sink (output port) will not add significantly to the flow into the central channel, but will slowly replenish source drops closer to the central channel. Transient flows can be observed when a small drop is placed between two relatively larger droplets with different volumes and resistance paths. Such an approach could be used to achieve timed dosing of samples, provided reactive components are appropriately isolated.

It can be appreciated that the present method provides a simple way to integrate functionalities into microfluidic devices without adding complexity to the fabrication process and to limit the dependence on external equipment. The method can be implemented in a high throughput manner with the use of multi-channel pipettes and robotic dispensers. While the current designs use the active placement of drops, platforms could also be constructed using responsive hydrogels to initiate fluid movement without deviating from the scope of the present invention. For example, the input ports could be isolated from the output drop by a hydrogel wall. If a certain condition is met in the solution, such as a pH, the wall could shrink to fluidly connect the input to the output.

Various modes of carrying out the invention are contemplated as being within the scope of the following claims particularly pointing out and distinctly claiming the subject matter, which is regarded as the invention.

We claim:

1. A method of controlling communication between multiple ports in a microfluidic device, comprising:

providing a first channel network in the microfluidic device, the first channel network including a first channel having a first input port, a second channel having a second input port, and an output port communicating with the first and second channels;

providing a second channel network in the microfluidic device, the second channel network including a channel input port in proximity to the output port of the first channel network and an output port;

filling the first and second channel networks with a fluid;

providing air-liquid interfaces at the output ports of the first and second channel networks, the air-liquid interfaces having radii of curvatures;

depositing a first input droplet having a radius of curvature on the first input port, the first input droplet flowing toward the output port of the first channel network in response to the first input droplet having a radius of curvature less than the radius of curvature of the air-liquid interface and forming a first output droplet having a dimension on the output port of the first channel network;

depositing a second input droplet having a radius of curvature on the second input port, the second input droplet flowing toward the output port of the first channel network in response to the second input droplet having a radius of curvature less than the radius of curvature of the air-liquid interface and increasing the dimension of the first output droplet on the output port of the first channel network; and wherein the first output droplet flows into the input port of the second channel network towards the output port of the second channel network in response to the dimension of the first outlet droplet exceeding a threshold.

2. The method of claim 1 wherein the first output droplet flows toward the first input port when the first input droplet has a radius of curvature greater than the radius of curvature of the first output droplet.

3. The method of claim 2 wherein the first output droplet flows toward the second input port in response to the radius of curvature of the second input droplet being greater than the radius of curvature of the first output droplet.

4. The method of claim 1 wherein the threshold is a predetermined volume.

5. The method of claim 1 comprising the additional step of depositing a second output droplet on the output port of the second channel network , the second output droplet having a radius of curvature wherein the first output droplet flows toward the output port of the second channel network in response to the first output droplet communicating with the input port of the second channel network and having a radius of curvature less than the radius of curvature of the second output droplet on the output port of the second channel network.

* * * * *